US006401377B1

(12) United States Patent
Vendetti et al.

(10) Patent No.: US 6,401,377 B1
(45) Date of Patent: Jun. 11, 2002

(54) RESETTABLE APPARATUS FOR USE WITH TRIGGER MECHANISM

(75) Inventors: Vincent J. Vendetti, Fredericksburg; Michael M. Canaday, King George; Charles F. Stevens, Montross, all of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/864,820

(22) Filed: May 24, 2001

(51) Int. Cl.[7] ..... F41A 19/00
(52) U.S. Cl. ..... 42/69.01; 42/70.06
(58) Field of Search ..... 42/69.01, 69.02, 42/70.06, 1.12, 1.14, 1.15; 89/136

(56) References Cited

U.S. PATENT DOCUMENTS

| | | | | | |
|---|---|---|---|---|---|
| 44,630 | A | * | 10/1864 | Hughes | 42/69.01 |
| 2,895,381 | A | * | 7/1959 | Musser | 89/127 |
| 2,911,837 | A | * | 11/1959 | Gannett et al. | 74/103 |
| 2,968,223 | A | * | 1/1961 | Weibel, Jr. | 89/136 |
| 3,153,874 | A | | 10/1964 | Merrill | 42/41 |
| 3,488,488 | A | | 1/1970 | Crouch | 240/6.41 |
| 3,708,902 | A | * | 1/1973 | Foster et al. | 42/1.01 |
| 4,754,568 | A | | 7/1988 | Brandt | 42/70.06 |
| 4,962,605 | A | | 10/1990 | Aigner | 42/69.01 |
| 4,986,019 | A | * | 1/1991 | Dennis, Jr. | 42/106 |
| 5,038,507 | A | * | 8/1991 | Dennis, Jr. | 42/69.01 |
| 5,606,825 | A | | 3/1997 | Olsen | 42/69.01 |
| 5,857,280 | A | | 1/1999 | Jewell | 42/69.03 |
| 5,946,841 | A | * | 9/1999 | Roper | 42/70.06 |

* cited by examiner

*Primary Examiner*—Michael J. Carone
*Assistant Examiner*—Gabriel Sukman
(74) *Attorney, Agent, or Firm*—James B. Bechtel, Esq.; Peter J. Van Bergen, Esq.

(57) ABSTRACT

A resettable trigger mechanism has an activating rod with a first portion slidably mounted in a housing and a second portion extending from the housing. The activating rod has a notch formed in its first portion. A trigger is coupled to the activating rod's second portion. A first spring coupled between the activating rod and housing biases the second portion towards the housing. A reset rod has a first section slidably mounted in the housing and a second section extending from the housing. The reset rod has a cutout portion formed in its first section for slidingly receiving therethrough the first portion of the activating rod. A second spring is coupled between the reset rod and housing for biasing the second section away from the housing. When the trigger is activated, the activating rod is pulled from the housing to align its notch with the cutout portion of the reset rod so that the reset rod can move under the force of the second spring until the reset rod's cutout portion engages the notch. When the trigger is to be reset, the reset rod is pushed towards the housing to disengage the cutout portion from the notch so that the activating rod is free to move under the force of the first spring thereby allowing the trigger to return to its ready-to-fire position.

15 Claims, 1 Drawing Sheet

FIG.1
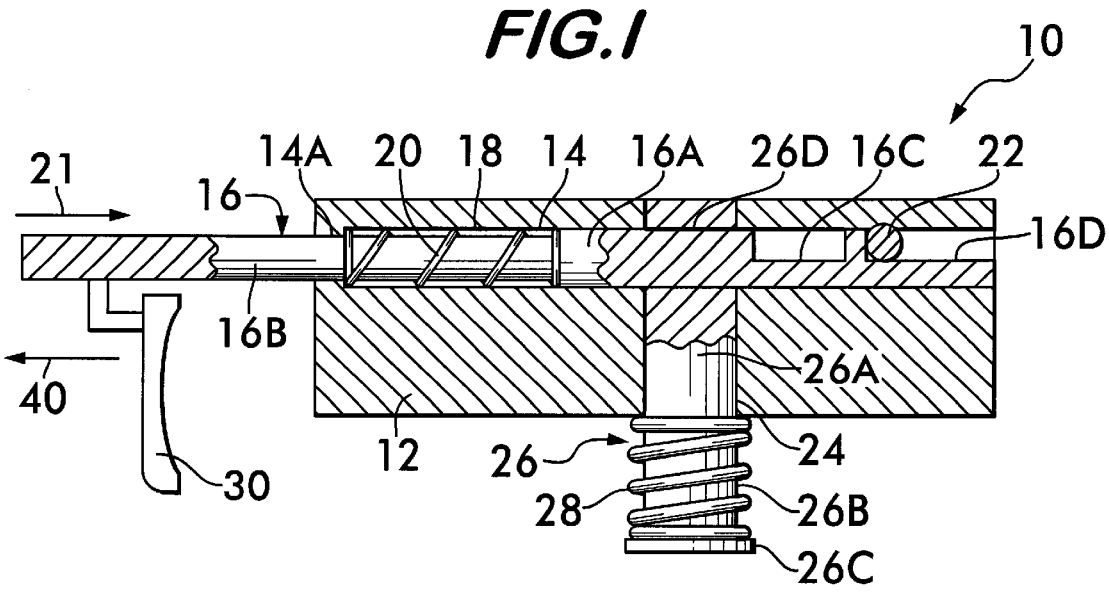
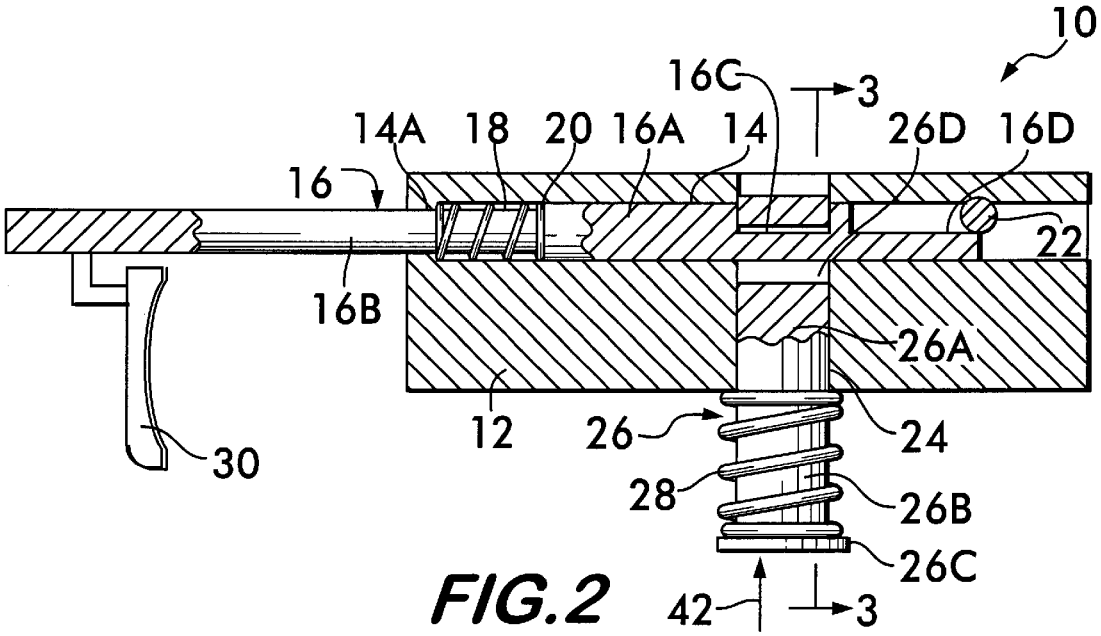
FIG.2
FIG.3
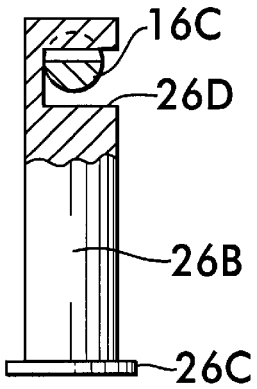
FIG.4
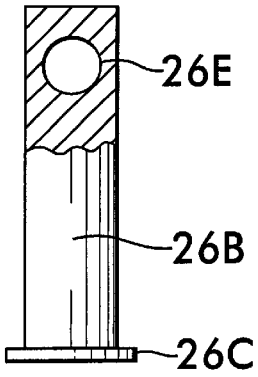

RESETTABLE APPARATUS FOR USE WITH TRIGGER MECHANISM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to resettable mechanisms, and more particularly to a resettable apparatus for use with a trigger that is to be reset after firing.

BACKGROUND OF THE INVENTION

In some weapon systems, trigger mechanisms are designed to be fired one time only, at which point they are rendered useless. While such "one time" trigger-mechanisms serve their purpose in actual use, the training of personnel to use the accompanying weapon system is time consuming and expensive as new trigger mechanisms must be installed/used for each training shot. Thus, in a training scenario, it would be preferable to reset the trigger without compromising the feel of a "one time" trigger.

SUMMARY OF THE INVENTION

Accordingly, it is an object of the present invention to provide a resettable trigger mechanism.

Another object of the present invention is to provide a resettable trigger mechanism that requires minimal effort in terms of resetting a trigger to a ready-to-fire position.

Other objects and advantages of the present invention will become more obvious hereinafter in the specification and drawings.

In accordance with the present invention, a resettable mechanism for use with a trigger that is to be reset to a ready-to-fire position. An activating rod has a first portion slidably mounted in a housing and a second portion extending from the housing. The activating rod has a notch formed in its first portion. A trigger coupled to the second portion is capable of movement between a ready-to-fire position and a fired position. A first spring is coupled between the activating rod and housing for biasing the second portion towards the housing. A reset rod has a first section slidably mounted in the housing and a second section extending from the housing. The reset rod has a cutout portion formed in its first section for slidingly receiving therethrough the first portion of the activating rod. A second spring is coupled between the reset rod and housing for biasing the second section away from the housing. When the trigger is moved from its ready-to-fire position to the fired position, the activating rod is pulled from the housing to align its notch with the cutout portion of the reset rod. At this point, the reset rod moves under the force of the second spring until the reset rod's cutout portion engages the notch. When the trigger is to be moved from its fired position to the ready-to-fire position, the reset rod is pushed towards the housing to disengage the cutout portion from the notch. At this point, the activating rod is free to move under the force of the first spring such that the trigger returns to its ready-to-fire position.

BRIEF DESCRIPTION OF THE DRAWINGS

FIG. 1 is a cross-sectional view of a resettable trigger mechanism according to the present invention in its ready-to-fire position;

FIG. 2 is a cross-sectional view of a resettable trigger mechanism in its fired position;

FIG. 3 is a cross-sectional view taken along line 3—3 in FIG. 2 illustrating an embodiment of the trigger mechanism's reset rod formed with a groove as its cutout portion; and FIG. 4 is a cross-sectional view of another embodiment of the trigger mechanism's reset rod formed with a through hole as its cutout portion.

DETAILED DESCRIPTION OF THE INVENTION

Referring now to the drawings, and more particularly to FIGS. 1 and 2, an embodiment of a resettable trigger mechanism 10 according to the present invention is shown in its ready-to-fire position (FIG. 1) and in its fired position (FIG. 2). Accordingly, like reference numerals will be used in both views for elements that are common therebetween.

A housing 12 is bored out at 14 to slidingly receive a rod 16. More specifically, rod 16 includes a portion 16A maintained within bore 14 and a portion 16B that extends from housing 12 through a reduced diameter portion 14A of bore 14. A corresponding reduced diameter of portion 16B allows an annular sleeve 18 to be defined within housing 12 such that a spring 20 can be captured between housing 12 and rod 16. Spring 20 biases rod 16 into housing 12 as indicated by direction arrow 21. Portion 16A of rod 16 is further notched at 16C for reasons that will become clearer later in the description. To prevent axial rotation of rod 16, portion 16A includes a flat portion 16D that slides on a pin 22 mounted transverse to rod 16 in housing 12. A trigger 30 is coupled to portion 16B of rod 16.

Housing 12 is further bored out at 24 to slidingly receive another rod 26 that, in the illustrated embodiment, is perpendicular to rod 16 as shown. More specifically, rod 26 includes a section 26A maintained within bore 24 and a section 26B that extends from housing 12. An annular flange 26C is formed on the outboard end of section 26B. A spring 28 is captured between flange 26C and housing 12 for biasing rod 26 away from housing 12. Part of section 26A is cutout at 26D to allow portion 16B of rod 16 to slidingly pass therethrough. Cutout 26D could be an open groove as illustrated in FIG. 3 or could be formed as a through hole 26E as illustrated in FIG. 4.

In use, resettable trigger mechanism 10 starts out at its ready-to-fire position illustrated in FIG. 1 where spring 20 is extended and spring 28 is compressed. When trigger 30 is squeezed (i.e., moved in the direction of arrow 40), rod 16 moves axially out of housing 12 until notch 16C is aligned with cutout 26D. At this point, rod 26 is free to move axially away from housing 12 under the force of spring 28 until cutout 26D engages notch 16C as shown in FIG. 2 thereby locking mechanism 10 in its fired position. When it is desired to reset mechanism 10, rod 26 is pushed towards housing 12 as indicated by arrow 42 in FIG. 2. Once this axial movement causes cutout 26D to disengage from notch 16C, rod 16 is again free to move axially into housing 12 under the force of spring 20 so that trigger 30 returns to its ready-to-fire position shown in FIG. 1.

The advantages of the present invention are numerous. The resettable trigger mechanism allows a "one time" trigger type of weapon to be used over and over again in a training scenario. The trigger reset is accomplished by simply pushing a button, i.e., the end of rod 26. In this way, training efficiency is greatly increased as an operator can quickly reset the trigger to prepare for another practice shot.

Although the invention has been described relative to a specific embodiment thereof, there are numerous variations and modifications that will be readily apparent to those skilled in the art in light of the above teachings. For example, while each of rods 16 and 26 is illustrated as being of one-piece construction, it is to be understood that these rods can be made in multiple sections to facilitate fabrication and/or assembly for a particular application. Further, the various elements can be solid as shown or hollow in applications where weight is a consideration. Still further, rods 16 and 26 need not be perpendicular to one another as illustrated, but could be positioned at other angles provided the notch (in rod 16) and cutout (in rod 26) were properly formed to allow sliding movement between the rods and positive engagement between the notch and cutout. It is therefore to be understood that, within the scope of the appended claims, the invention may be practiced other than as specifically described.

What is claimed as new and desired to be secured by Letters Patent of the United States is:

1. A resettable apparatus comprising:

a housing;

an activating rod having a first portion slidably mounted in said housing and a second portion extending from said housing, said activating rod having a notch formed in said first portion thereof;

a first spring coupled between said activating rod and said housing for biasing said second portion towards said housing;

a reset rod having a first section slidably mounted in said housing and a second section extending from said housing, said reset rod having a cutout portion formed in said first section for slidingly receiving therethrough said first portion of said activating rod; and a second spring coupled between said reset rod and said housing for biasing said second section away from said housing wherein, when said activating rod is pulled from said housing until said notch is aligned with said cutout portion, said reset rod moves under the force of said second spring until said cutout portion and said notch engage one another, and wherein, when said reset rod is pushed towards said housing until said cutout portion and said notch disengage, said activating rod moves under the force of said first spring.

2. A resettable apparatus as in claim 1 wherein said activating rod and said reset rod are perpendicular to one another.

3. A resettable apparatus as in claim 1 further comprising means for preventing axial rotation of said activating rod.

4. A resettable apparatus as in claim 1 wherein said first spring is maintained within said housing.

5. A resettable apparatus as in claim 1 wherein said second spring is maintained outside of said housing.

6. A resettable apparatus as in claim 1 wherein said cutout portion is a groove formed in said first section.

7. A resettable trigger mechanism comprising:

a housing;

an activating rod having a first portion slidably mounted in said housing and a second portion extending from said housing, said activating rod having a notch formed in said first portion thereof;

a trigger coupled to said second portion, said trigger capable of movement between a ready-to-fire position and a fired position;

a first spring coupled between said activating rod and said housing for biasing said second portion towards said housing;

a reset rod having a first section slidably mounted in said housing and a second section extending from said housing, said reset rod having a cutout portion formed in said first section for slidingly receiving therethrough said first portion of said activating rod; and a second spring coupled between said reset rod and said housing for biasing said second section away from said housing wherein, when said trigger is moved from said ready-to-fire position to said fired position, said activating rod is pulled from said housing to align said notch with said cutout portion wherein said reset rod moves under the force of said second spring until said cutout portion engages said notch, and wherein, when said trigger is to be moved from said fired position to said ready-to-fire position, said reset rod is pushed towards said housing to disengage said cutout portion from said notch wherein said activating rod is free to move under the force of said first spring such that said trigger returns to said ready-to-fire position.

8. A resettable trigger mechanism as in claim 7 wherein said activating rod and said reset rod are perpendicular to one another.

9. A resettable trigger mechanism as in claim 7 further comprising means for preventing axial rotation of said activating rod.

10. A resettable trigger mechanism as in claim 7 wherein said first spring is maintained within said housing.

11. A resettable trigger mechanism as in claim 7 wherein said second spring is maintained outside of said housing.

12. A resettable trigger mechanism as in claim 7 wherein said cutout portion is a groove formed in said first section.

13. A resettable trigger mechanism comprising:

a housing;

an activating rod having a first portion slidably mounted in said housing and a second portion extending from said housing, said activating rod having a notch formed in said first portion thereof;

a trigger coupled to said second portion, said trigger capable of movement between a ready-to-fire position and a fired position;

a first spring coupled between said activating rod and said housing for biasing said second portion towards said housing;

a reset rod having a first section slidably mounted in said housing perpendicular to said first portion, said reset rod having a second section extending from said housing, said reset rod having a groove formed in said first section for slidingly receiving therethrough said first portion of said activating rod;

means coupled to said housing for preventing axial rotation of said first portion of said activating rod in said housing; and a second spring coupled between said reset rod and said housing for biasing said second section away from said housing wherein, when said trigger is moved from said ready-to-fire position to said fired position, said activating rod is pulled from said housing to align said notch with said groove wherein said reset rod moves under the force of said second spring until said groove engages said notch, and wherein, when said trigger is to be moved from said fired position to said ready-to-fire position, said reset rod is pushed towards said housing to disengage said groove from said notch wherein said activating rod is free to move under the force of said first spring such that said trigger returns to said ready-to-fire position.

14. A resettable trigger mechanism as in claim 13 wherein said first spring is maintained within said housing.

15. A resettable trigger mechanism as in claim 13 wherein said second spring is maintained outside of said housing.

* * * * *